US005878894A

United States Patent [19]

Robertson

[11] Patent Number: 5,878,894

[45] Date of Patent: Mar. 9, 1999

[54] MERCHANDISING TRACK DEVICE HAVING FRONT MASK

[75] Inventor: James David Robertson, Atlanta, Ga.

[73] Assignee: The Mead Corporation, Dayton, Ohio

[21] Appl. No.: 872,725

[22] Filed: Jun. 11, 1997

[51] Int. Cl.[6] ..... A47F 5/00

[52] U.S. Cl. ..... 211/59.2

[58] Field of Search ..... 211/59.2, 74, 113, 211/117, 118, 208, 209; 248/317, 328; 108/107, 149; 312/234

[56] References Cited

U.S. PATENT DOCUMENTS

| | | | |
|---|---|---|---|
| 1,611,036 | 12/1926 | Hovda | 209/677 |
| 3,831,769 | 8/1974 | Frank | 211/113 |
| 4,318,485 | 3/1982 | Clement | 211/59.2 |
| 4,367,818 | 1/1983 | Suttles | 211/59.2 |
| 4,401,221 | 8/1983 | Suttles | 211/59.2 |
| 4,556,183 | 12/1985 | Greenberger | 248/222.12 |
| 4,775,058 | 10/1988 | Yatsko | 211/184 |
| 4,830,201 | 5/1989 | Breslow | 211/184 |
| 5,042,768 | 8/1991 | Goldstein | 248/223.41 |
| 5,586,687 | 12/1996 | Spamer et al. | 221/298 |
| 5,706,956 | 1/1998 | Headrick et al. | 211/59.2 |
| 5,706,958 | 1/1998 | Spamer | 211/59.2 |
| 5,706,978 | 1/1998 | Spamer et al. | 211/59.2 |
| 5,755,341 | 5/1998 | Spamer | 211/59.2 |
| 5,779,068 | 7/1998 | Whiten et al. | 211/59.2 |

FOREIGN PATENT DOCUMENTS 2 647 328 11/1990 France .

*Primary Examiner*—Alvin Chin-Shue
*Assistant Examiner*—Sarah Purol
*Attorney, Agent, or Firm*—Tsugihiko Suzuki

[57] ABSTRACT

A merchandising device comprises a display shelf including a plurality of elongate parallel tracks arranged side by side with a gap between adjacent tracks. Each track is designed to support a row of articles in such a manner that the articles are suspended from each track for movement along a path defined by that track and are removable from that track through its front end. The device further comprises a mask for providing the display shelf with an appearance of a unitary structure. The mask comprises an elongate mounting member extending along the front edge of the display shelf to fixedly position the mask relative to the display shelf, and a plurality of covering members arranged in a row along the mounting member. Each covering member spans the respective gap to provide a billboard surface extending between adjacent tracks.

18 Claims, 4 Drawing Sheets

MERCHANDISING TRACK DEVICE HAVING FRONT MASK

BACKGROUND OF THE INVENTION

This invention relates to merchandising devices for articles such as soft drink bottles, and particularly to a suspension-type display device in which articles are suspended from a plurality of spaced parallel tracks.

Suspension-type display devices have been used in the merchandising of soft drink bottles such as PET bottles having outwardly projecting annular neck flanges. These devices have a plurality of elongate tracks supported on a rack wherein the tracks are arranged side by side in a spaced parallel relationship. Each track has a pair of parallel rails extending along that track. The necks of flanged bottles are received between the rails of each track so that the bottles are engaged at their neck flanges with the rails and thus suspended from the respective track. The bottles received in each track are automatically arranged in a tidy row along the respective track and presented for removal by customers through the front end of the respective track. The distance between adjacent tracks are great enough to prevent interference between the bottles suspended from the adjacent tracks. To assure such a distance, it is typical that a certain gap or space is defined between adjacent tracks.

Conventional merchandising devices of the type described above are disclosed, for example, in U.S. Pat. Nos. 4,318,485; 4,367,818; 4,401,221; 5,586,687 which are owned by the assignee of the present invention and in U.S. Pat. No. 5,586,665 and French Published Application No. 2,647,328.

SUMMARY OF THE INVENTION

The present invention provides a merchandising device which comprises a display shelf including a plurality of elongate parallel tracks arranged side by side with a gap between adjacent tracks. Each track is designed to support a row of articles in such a manner that the articles are suspended from each track for movement along a path defined by that track and are removable from that track through its front end. The device further comprises masking means for providing the display shelf with an appearance of a unitary structure. The masking means comprises an elongate mounting member disposed along the front edge of the display shelf to fixedly position the masking means relative to the display shelf, and a plurality of covering members arranged in a row along the mounting member. The covering members are located such that each covering member spans the respective gap to provide a billboard surface extending between adjacent tracks.

According to a preferred embodiment of the invention, the mounting member extends entirely along the front edge of the display shelf.

According to another preferred embodiment, the mounting member is removably mounted on the display shelf.

According to another preferred embodiment, the mounting member and the covering members are molded together as a unitary structure.

According to another preferred embodiment, the mounting member is secured to at least one of the tracks. For example, each track may have a pair of side walls interconnected by a top wall so as to form a channel structure, and the mounting member may be secured to the top wall(s) of one or more tracks. In this embodiment, the masking means may further comprise webs disposed along the mounting member at the locations between the covering members so that each web covers the forward edge of the top wall of the respective track. The mounting member may be a panel strip disposed parallel to the top walls of the tracks, and the covering members may be joined to and extended downwardly from the front edge of the panel strip. The masking means may further comprise a channel member secured to the upper face of the panel strip. The channel member may have front and rear opposing lipped flanges extending along the panel strip to define channels for slidably receiving the front and rear edges of a printed information card.

According to a further embodiment of the invention, the covering members are arranged at horizontal spacings, and the distance of the side walls of each track is generally equal to each horizontal spacing.

According to another aspect of the invention, a merchandising device is provided which comprises the aforementioned display shelf. Each track of the display shelf comprises a pair of side walls interconnected by a top wall to form a channel structure. The merchandising device of this aspect further comprises masking means for providing said display shelf with an appearance of a unitary structure. The masking means comprises a plurality of covering members arranged in a row at horizontal spacings along the front edge of the display shelf to cover the forward edges of the side walls of the tracks, and a plurality of webs provided to link the covering members together in series. Each web extends between adjacent covering members to cover the forward edge of the top wall of the respective track.

DETAILED DESCRIPTION OF THE PREFERRED EMBODIMENT

FIGS. 1–4 illustrate a merchandising device according to this invention. The device includes one or more bottle display shelves of the kind shown in FIG. 1 removably mounted on a rack. The rack may be a four-post rack as partially shown in FIG. 1. Details of the four-post rack are described in U.S. patent application Ser. No. 08/684,357 owned by the assignee of the present invention, which is hereby incorporated by reference. Alternatively, the rack may be composed of a base having a vertically extending back wall on which shelf-supporting arms are cantilevered. The merchandising device may have only one display shelf; however, it will in general have two or more display shelves arranged one above another.

Figure 1:
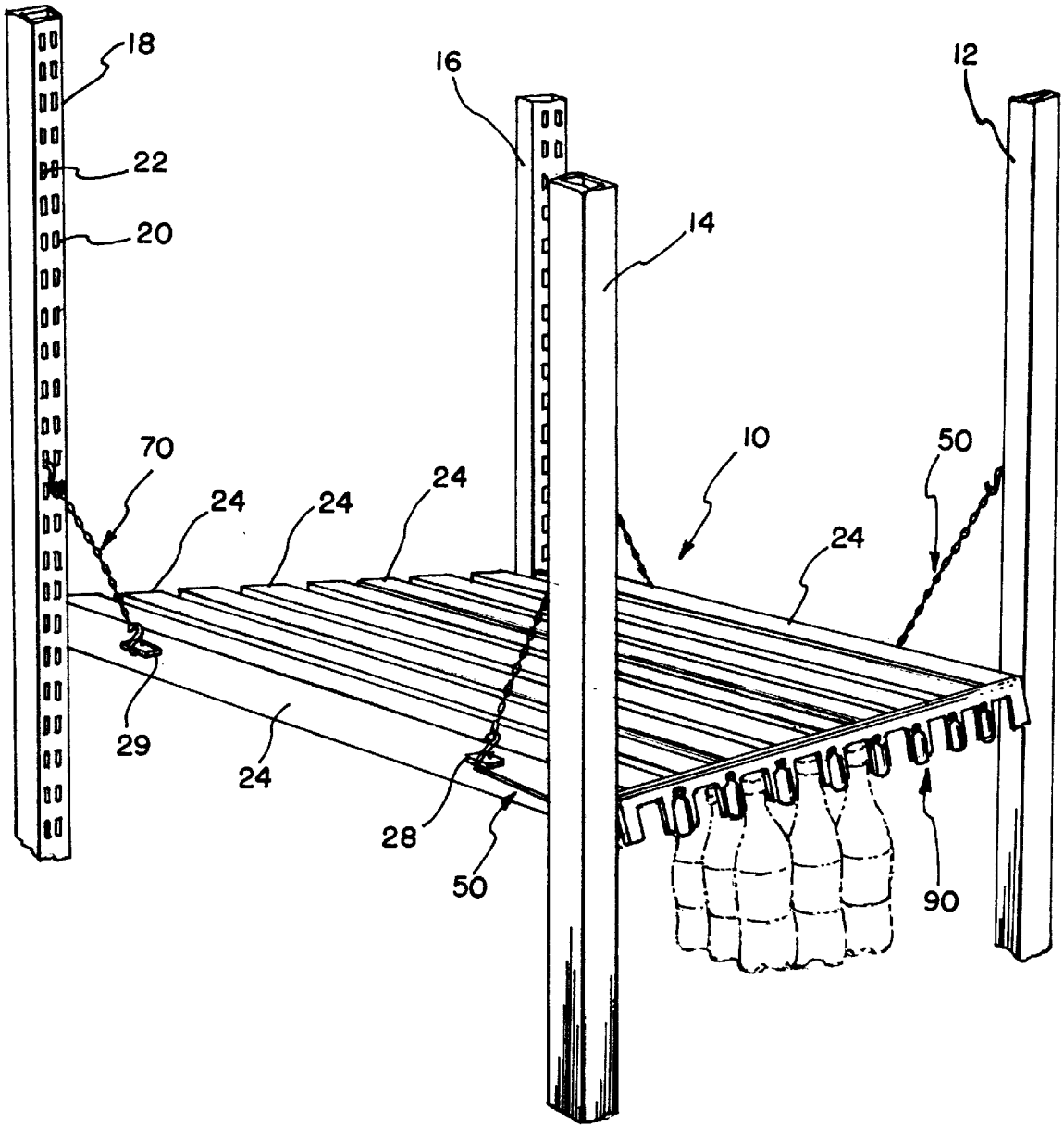
FIG. 1 is a perspective view of a suspension-type merchandising device according to the present invention.

The display shelf 10 in FIG. 1 is designed for use preferably on a four-post rack having four upright corner posts, i.e., a pair of front posts 12 and 14 and a pair of rear posts 16 and 18, connected together by horizontal members (not shown) of a suitable number. The four corner posts 12, 14, 16 and 18 are of substantially the same structure having a number of engaging openings arranged vertically along the side wall of the respective corner post. In FIG. 1, each post is shown as having two vertical rows of openings 20 and 22. However, one vertical row of openings in each corner post may be sufficient in most of the cases.

The display shelf 10 has a plurality of spaced parallel tracks 24 having their front ends disposed between the front posts 12 and 14. These front ends are aligned to define the front edge of the display shelf 10 which front edge extends perpendicularly to the length of the tracks 24. Each track 24 extends backward from the front edge of the shelf. The tracks 24 are interconnected through a pair of front and rear transverse support members 28 and 29 extending perpendicularly to the tracks 24. The front and rear transverse members 28 and 29 are virtually identical to each other.

Figure 3:
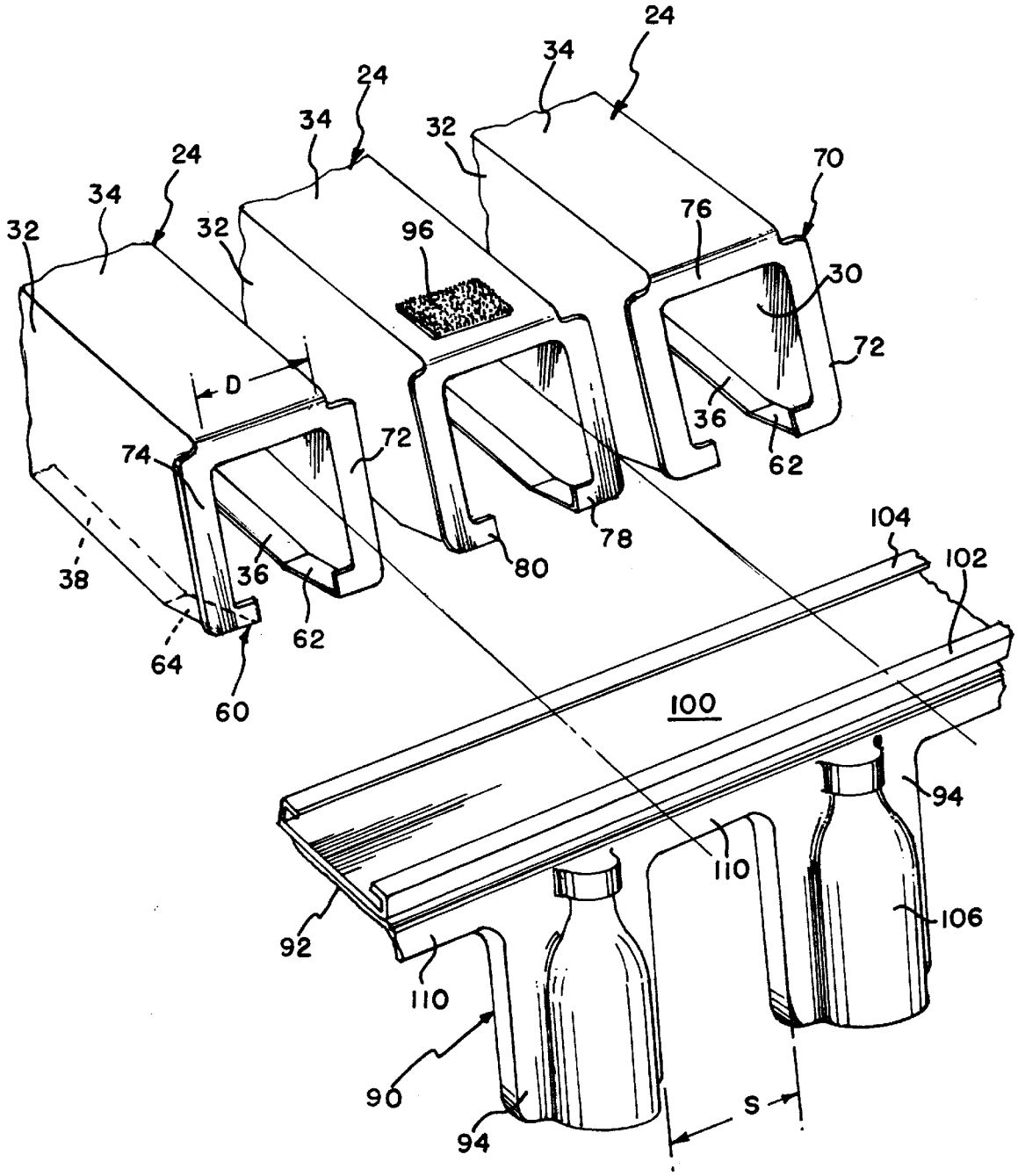
FIG. 3 is an exploded view of the merchandising device in FIG. 2.

Each track 24 is formed preferably of a metal plate or a molded plastic. As best illustrated in FIG. 3, each track 24 has a pair of longitudinally extending opposed side walls 30 and 32 joined together along their upper edges by a top wall 34. The side walls 30 and 32 and the top wall 34 in cooperation form a channel structure having an inverted U-shaped cross section. A pair of parallel rails 36 and 38 are joined respectively along the lower edges of the side walls 30 and 32 and project inwardly of the respective track 24. A space is maintained between the rails 36 and 38 to receive therein the necks of flanged bottles. The distance between the rails 36 and 38 is such that when bottle necks are received between the rails 36 and 38, the bottles are automatically arranged in a row and the undersides of the neck flanges engage the rails 36 and 38 to allow the bottles to be suspended for sliding movement along the respective track 24. When each track 24 is supported to incline to its front end, the suspended bottles gravity feed one after another to the front end of the respective track 24 as the leading bottles on that track successively are removed from that track through the front end.

Typical flanged bottles used with the device of the invention may be soft drink bottles formed of plastic such as PET and having integrally formed outwardly projecting annular flanges at their necks immediately under their caps. The bottles suspended by their neck flanges are shown in dotted lines in FIG. 1. The detailed manner in which the bottles are suspended by their neck flanges is described in U.S. Pat. No. 5,586,687, owned by the assignee of the present application, which is hereby incorporated by reference.

As also shown in FIG. 3, each track 24 is provided with a stopper 60 at its front end. The stopper 60 comprises a length of the respective track 24 adjacent to its front end. Such a length is upturned relative to the immediately preceding length of the respective track 24 to provide forwardly upturned portions 62 and 64 of the rails 36 and 38. When the leading bottles in each track 24 travel along the upturned portions 62 and 64, they are braked to a stop and presented for removal from that track 24. The upturned length of each track 24 may be formed integrally with that track 24 or it may be provided as a separate replaceable portion.

As further shown in FIG. 3, each track 24 is provided at the front end with a generally C-shaped end flange 70 which is designed to increase the rigidity of the front end. The end flange 70 includes a pair of opposed side portions 72 and 74 formed respectively along the forward edges of the side walls 30 and 32. The side portions 72 and 74 extend outwardly from the side walls 30 and 32. These side portions 72 and 74 are interconnected by a top portion 76 which is formed along the forward edge of the top wall 34 and extending downwardly and inwardly therefrom. The end flange 70 terminates with inwardly turned ends 78 and 80 which constitute the forward ends of the upturned portions 62 and 64. These ends 78 and 80 are greater in thickness than the remainder of the rails 36 and 38 and thereby prevent the rails 36 and 38 from being mistakenly received between the cap and the flange of a bottle.

Figure 4:
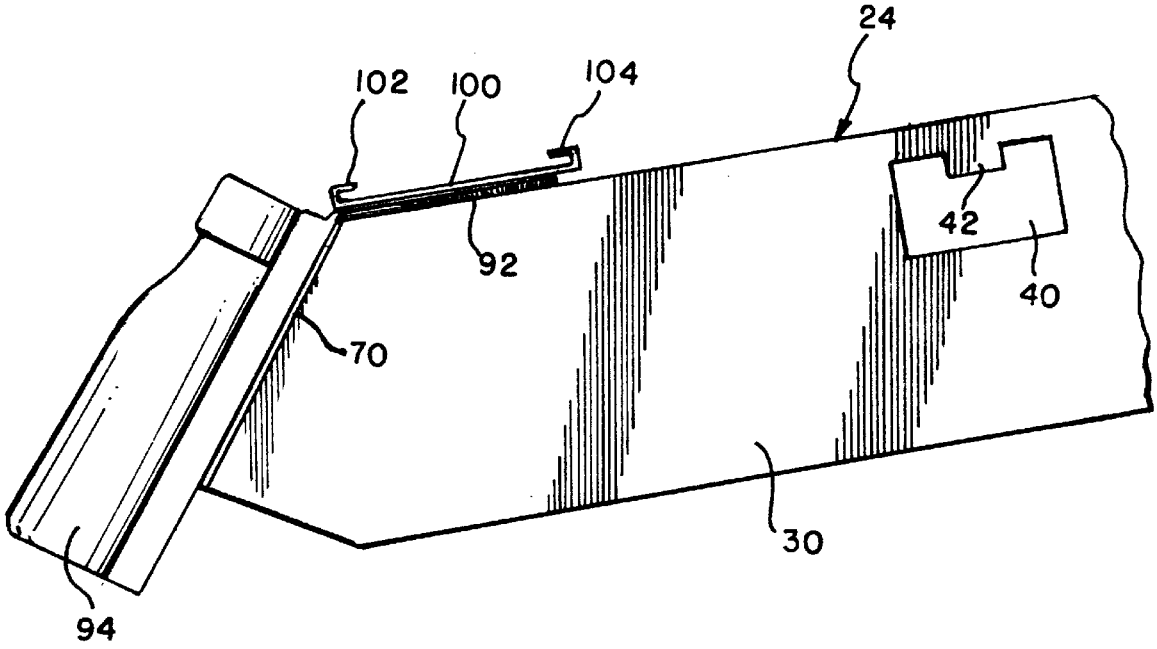
FIG. 4 is a side elevation of the device in FIG. 2.

The side walls 30 and 32 of each track 24 are provided at near each track end with a pair of opposed generally rectangular apertures 40 (only one shown in FIG. 4). The apertures 40 near the front end of each track 24 are identical in size and receive the front transverse member 28 so that the front end portion of that track 24 is supported by the member 28. The size of the front end apertures 40 is such that the apertures 40 allow the track 24 to slide along the front transverse member 28. The apertures 40 near the rear end of each track 24 are of the same size and receive the rear transverse member 29 so that the rear end portion of that track 24 is supported by the rear transverse member 29. The rear end apertures 40 also allow the track 24 to slide along the member 29.

As shown in FIG. 4, a tab 42 projects downwardly from the perimeter of each of the front and rear end apertures 40. These tabs 42 are provided to be received in recesses or openings (not shown) in the transverse members 28 and 29 to lock the respective track 24 in a selected position on the members 28 and 29.

The front transverse member 28 is of a rectangular tube structure formed of metal or plastic. It passes through all the tracks 24 in the display shelf, and it is mounted at its opposite ends on the front uprights 12 and 14 by means of a pair of front joints 50 (shown in FIG. 1). Details of such front joints are described in U.S. patent application Ser. No. 08/684,357.

The rear transverse member 29 also passes through all the tracks 24 and is mounted at its opposite ends on the rear uprights 16 and 18 by means of a pair of rear joints 70 (only one shown in FIG. 1). Details of the rear joints are described also in U.S. patent application Ser. No. 08/684,357.

The slots 20 and 22 of the posts 12, 14, 16 and 18 with which the front and rear joints 50 and 70 are engaged are selected such that each of the front and rear transverse members 28 and 29 is held substantially horizontally while the rear member 29 is supported at the position higher than the front member 28. Such an arrangement permits the tracks 24 to be inclined downwardly toward their respective front ends. The inclination of the tracks 24 allows the bottles on the tracks to gravity feed to the front ends as the leading bottles on each track are removed successively from that track.

Figure 5:
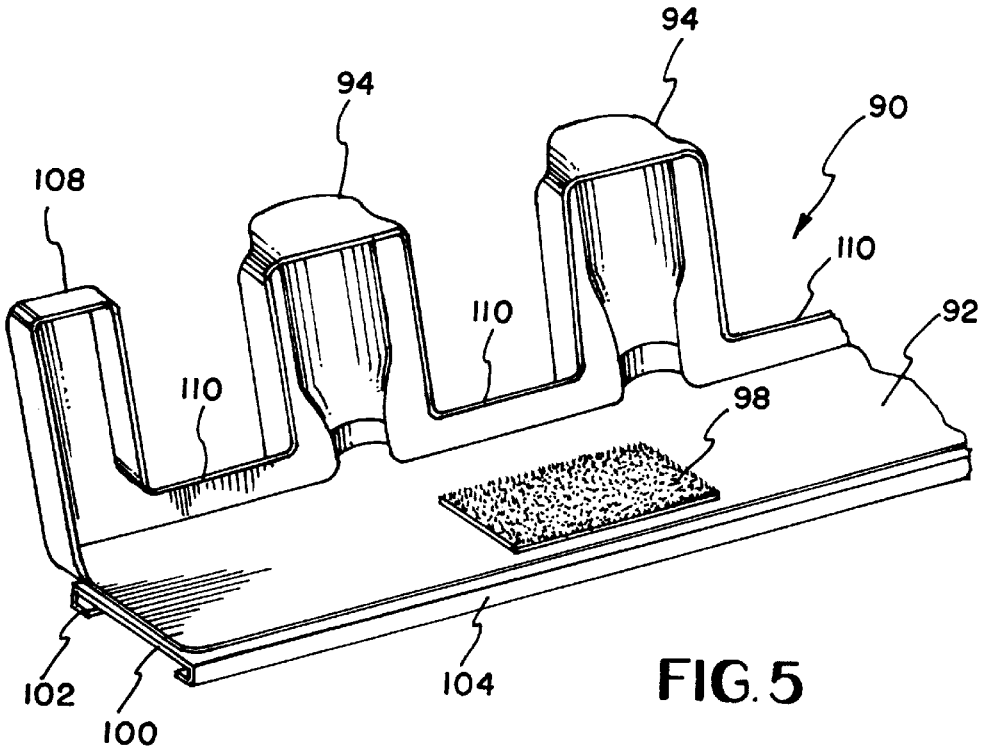
FIG. 5 is a perspective view of the masking means in FIG. 3, showing the rear side of the mounting member
Figure 2:
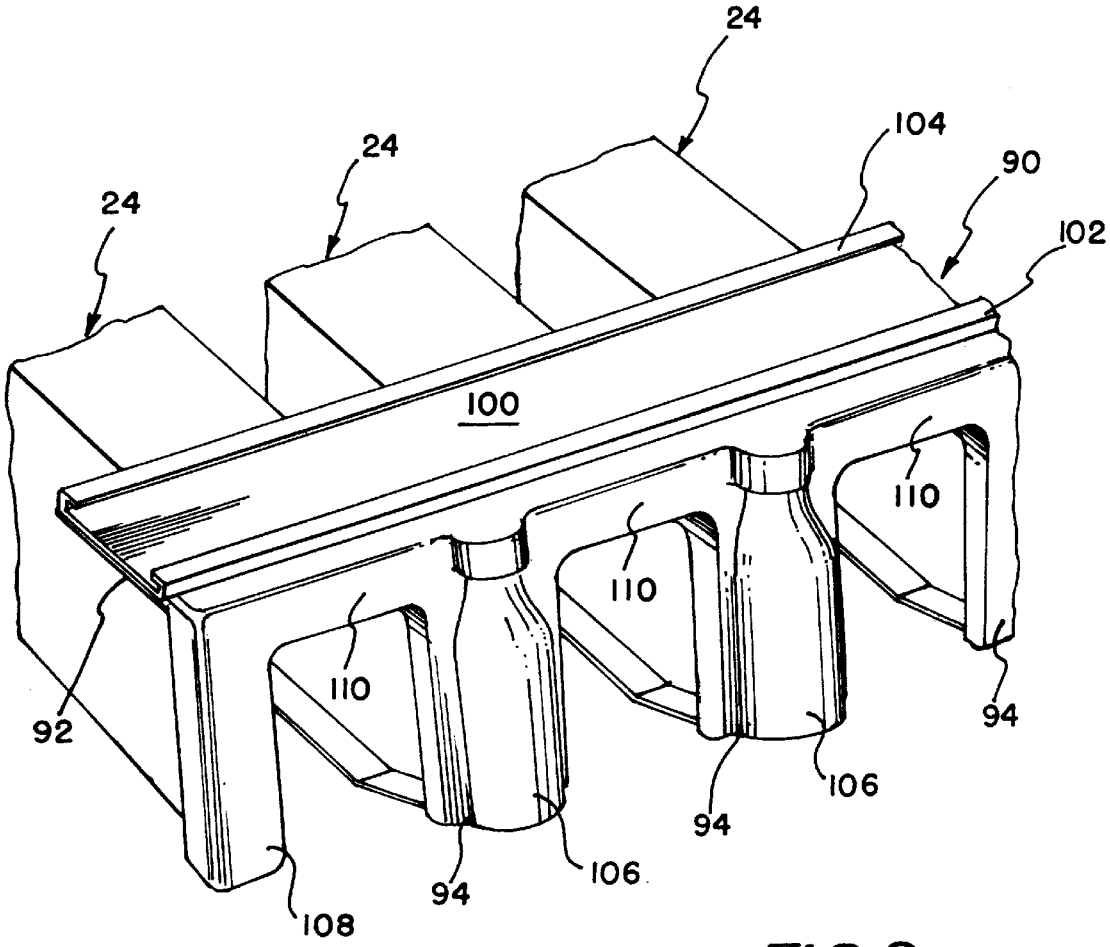
FIG. 2 is an enlarged fragmentary perspective view of the merchandising device in FIG. 1, showing the forward portions of three tracks covered by masking means.

As best shown in FIG. 2, a shelf mask 90 is mounted on the display shelf. The illustrated mask 90 is formed of plastics, and includes an elongate mounting member 92 (best shown in FIG. 5) extending along the front edge of the display shelf. The illustrated mounting member 92 is a panel strip having on its lower side with one or more Velcro™ fasteners 98 (shown in FIG. 5). By means of these fastener (s) 98, the mounting member 92 is removably attached to the top wall(s) 34 of one or more of the tracks 24 where one or more cooperating Velcro™ fasteners 96 (shown in FIG. 3) are provided. A channel member 100 is secured to the upper side of the mounting member 92 by means of glue, ultrasonic welding or the like. The channel member 100 is provided with front and rear opposing lipped flanges 102 and 104 formed respectively along the length of the channel member 100. The flanges 102 and 104 extend upwardly and then turned toward each other, thereby defining channels for slidably receiving the opposed edges of a printed card (not shown). The term "printed card" as used in this application refers to any removable information media that carries information such as an advertisement, a trademark, a price of the bottles displayed on the shelf. However, the channel member 100 may carry fixed information media such as a sticker, a tape or a coating.

A plurality of covering members 94 are arranged in a row along the mounting member 92 at a pitch generally equal to the pitch at which the tracks 24 are arranged. As shown in FIG. 4, these covering members 94 extend downwardly from the mounting member 92 along the forward edges of the side walls 30 and 32 of the tracks 24 to cover the end flanges 70. More specifically, each covering member 94 is disposed to span the gap between neighboring tracks 24 as well as to cover the adjacent side portions of neighboring end flanges 70. Such covering members 94 provide a billboard surface extending between neighboring tracks 24. Reference numeral 108 in FIG. 2 designates an end covering member provided at one end of the mask 90 to cover the side portion 74 of the end flange 70 of the end track 24. A similar end covering member is also provided at the other end of the mask 90.

As further illustrated in FIG. 2, a plurality of webs 110 are formed along the front edge of the mounting member 92 at the locations between the covering members 94. These webs 110 link the covering members 94 together in series and cover the top portions 76 of the end flanges 70.

In the illustrated embodiment, the covering members 94 are embossed with graphics 106 such as bottle shapes, ice patterns, logos, trademarks, price figures, or the like. The embossments may be easily created by vacuum-forming the covering members 94. When the graphics are embossed, it is preferred that the mounting member 92, the covering members 94 and webs 110 are molded together as a unitary structure.

Each covering member 94 is preferably of the size such that the horizontal spacing "S" (shown in FIG. 3) between adjacent covering members 94 is generally equal to the distance "D" of the side walls 30 and 32 of each track 24. This arrangement allows all the gaps among the tracks 24 to be hidden from customers' view and thereby provides the display shelf with an appearance of a unitary structure rather than the appearance of the naked display shelf wherein the separate tracks 24 are assembled together.

It will be recognized that many variations may be made to the foregoing within the scope of the present invention. For example, the mounting member 92 may be secured to the display shelf by double sided tapes or any other removable fastening means such as screws, push fasteners, hollow wall fasteners or the like. Alternatively, the mounting member 92 may be mounted at its opposite ends on the front posts 12 and 14.

It will be further recognized that the mask 90 may alternatively be formed of metal such as aluminum or it may be assembled from two or more separate parts each formed of metal and/or plastic.

It will be further recognized that instead of embossing the graphics on the covering members, each covering member may have a flat billboard surface on which information media such as a sticker, a tape or a coating is carried. Such flat billboard surface may also be formed with a pair of upper and lower opposed lipped flanges for slidably receiving information media such as a printed card.

What is claimed is:

1. A merchandising device comprising:

a display shelf including a plurality of elongate parallel tracks arranged side by side with a gap between adjacent ones of said tracks, each of said tracks being adapted to support a row of articles such that said articles in said row are suspended from said each track for movement along a path defined by said each track and are removable from said each track through a front end of said each track, said front ends of said tracks being aligned to define a front edge of said display shelf extending transversely of said tracks; and masking means for providing said display shelf with an appearance of a unitary structure, said masking means comprising an elongate mounting member disposed along said front edge of said display shelf to fixedly position said masking means relative to said display shelf, and a plurality of covering members arranged in a row along said mounting member such that each of said covering members spans a respective one of said gaps to provide a billboard surface extending between said adjacent tracks.

2. The merchandising device according to claim 1, wherein said mounting member extends entirely along said front edge of said display shelf.

3. The merchandising device according to claim 1, wherein said mounting member is removably mounted on said display shelf.

4. The merchandising device according to claim 1, wherein said mounting member and said covering members are molded together as a unitary structure.

5. The merchandising device according to claim 1, wherein said mounting member is mounted on at least one of said tracks.

6. The merchandising device according to claim 5, wherein said each track comprises a pair of side walls interconnected by a top wall so as to form a channel structure, and said mounting member is secured to said top wall of said at least one track.

7. The merchandising device according to claim 6, wherein said covering members are arranged at horizontal spacings, and said mask further comprises webs disposed along said mounting member at locations between said covering members so that each of said webs covers a forward edge of said top wall of a respective one of said tracks.

8. The merchandising device according to claim 6, wherein said mounting member comprises a panel strip disposed parallel to said top walls of said tracks, said panel strip having a front edge extending along said front edge of said display shelf, said covering members being joined to and extending downwardly from said front edge of said panel strip.

9. The merchandising device according to claim 8, wherein said mask further comprises a channel member secured to an upper face of said panel strip, said channel member having front and rear opposing lipped flanges extending along said panel strip, said lipped flanges defining channels for slidably receiving front and rear edges of a printed information card.

10. The merchandising device according to claim 6, wherein said covering members are arranged at horizontal spacings, and the distance of said side walls of said each track is generally equal to an adjacent one of said horizontal spacings.

11. The merchandising device according to claim 1, further comprising support means for supporting said tracks in a side-by-side disposition, said support means comprising a pair of front and rear transverse support members disposed generally perpendicularly to said tracks, said each track comprising first means for mounting said each track on said front transverse member for movement along said front transverse member, and second means for mounting said each track on said rear transverse member for movement along said rear transverse member, said device further comprising means for preventing said tracks from movement along said transverse members.

12. The merchandising device according to claim 11, wherein said each track comprises a pair of side walls interconnected by a top wall to form a channel structure, each of said first and second mounting means of said each track comprises a pair of engaging apertures formed respectively in said side walls of said each track so as to slidably receive a respective one of said front and rear transverse members, and said preventing means further comprises a plurality of recesses formed in each of said transverse members to receive edges of respective ones of said apertures of said each track.

13. The merchandising device according to claim 1, further comprising support means for supporting said tracks such that said each track is inclined downwardly toward said front end thereof whereby said articles when supported by said each track are allowed to gravity feed toward said front end of said each track along said path.

14. A merchandising device comprising:

a display shelf including a plurality of elongate parallel tracks arranged side by side, each of said tracks being adapted to support a row of articles such that said articles in said row are suspended from said each track for movement along a path defined by said each track and are removable from said each track through a front end of said each track, said front ends of said tracks being aligned to define a front edge of said display shelf extending transversely of said tracks, said each track comprising a pair of side walls interconnected by a top wall so as to form a channel structure; and masking means for providing said display shelf with an appearance of a unitary structure, said masking means comprising a plurality of covering members arranged in a row at horizontal spacings along said front edge of said display shelf to cover forward edges of said side walls of said tracks, and a plurality of webs for linking said covering members together in series, each of said webs extending between adjacent ones of said covering members to cover a forward edge of said top wall of a respective one of said tracks.

15. The merchandising devise according to claim 14, wherein said covering members are located such that each of said covering members covers said forward edges of adjacent side walls of neighboring ones of said tracks.

16. The merchandising device according to claim 14, wherein said masking means further comprises an elongate mounting member disposed along said front edge of said display shelf to fixedly position both said covering members and said webs relative to said display shelf.

17. The merchandising device according to claim 14, wherein said each track further comprises an end flange joined to said front end thereof, and said covering members and said webs are disposed to cover said end flanges of said tracks.

18. The merchandising device according to claim 17, wherein said end flange of said each track comprises a pair of opposed side portions formed respectively along said forward edges of said side walls of said each track, and a top portion formed along said forward edge of said top wall of said each track to interconnect said side portions, and wherein said covering members cover said side portions of said end flanges, and said webs cover said top portions of said end flanges.

* * * * *